United States Patent [19]

Bayer

[11] 4,169,260

[45] Sep. 25, 1979

[54] CAPACITIVE INTRUSION DETECTOR CIRCUITRY UTILIZING REFERENCE OSCILLATOR DRIFT

[75] Inventor: Robert S. Bayer, West Milford, N.J.

[73] Assignee: Mosler Safe Company, Hamilton, Ohio

[21] Appl. No.: 895,383

[22] Filed: Apr. 11, 1978

[51] Int. Cl.[2] ..... G08B 13/26

[52] U.S. Cl. ..... 340/562; 331/65

[58] Field of Search ..... 340/562; 331/65

[56] References Cited

U.S. PATENT DOCUMENTS

| | | | |
|---|---|---|---|
| 3,276,005 | 9/1966 | Quist et al. | 340/562 |
| 3,510,677 | 5/1970 | Lister | 340/562 |
| 4,091,371 | 5/1978 | Mason, Jr. et al. | 340/562 |

*Primary Examiner*—Glen R. Swann, III

*Attorney, Agent, or Firm*—Wood, Herron and Evans

[57] ABSTRACT

Protected objects are connected together to form an antenna. Preferably, the cabinet for the detector circuitry is also included in the antenna. The antenna is excited by a voltage controlled oscillator (VCO). The capacitive reactance of the antenna changes when an intrusion occurs. This causes the frequency of the VCO signal to undergo an instantaneous change. A phase comparator compares the phase of the VCO signal with the phase of a reference oscillator signal. An instantaneous change in the frequency of the VCO signal due to a change in the capactive reactance of the antenna when an intrusion occurs is reflected by a shift in phase between the VCO signal and the reference oscillator signal. This causes the phase comparator signal to change. A deriving means, preferably including a dual differentiator circuit, which derives the rate of the rate of change of the phase comparator signal, and a differential comparator, which is triggered by the dual differentiator circuit in the event of an intrusion, activates a signaling circuit so as to produce an alarm when an intrusion occurs. Since the antenna is connected to the VCO and there is no bidirectional coupling between the VCO and the reference oscillator, the electronic security apparatus is incapable of defeat by connection of a frequency generator to the antenna, because inherent drift in the reference oscillator eventually produces an alarm. Additional features are also disclosed.

9 Claims, 2 Drawing Figures

LM305AH
Z1 REF. OSC.
Z2 VCO & PHASE COMP.
Z3 SW.
Z4
Z5
Z6
Z7A SW.
Z7B SW.
Z10 COUNTER
ASTABLE MULTIVIBRATOR
+8V
+13V
(+13V)
K
D
B
R'
CR1
CR2
CR3
CR5
CR6
C1 .1μf 16V
C2 .1μf 16V
C3 .1μf 16V
C4 .50pf 1000V
C5 10μf 25V
C6 .1μf 16V
C8 .1μf 16V
C9 .1μf-50V
C10 .001μf 200V
C11 .001μf 200V
C12 .1μf-50V
C13 220μf 10V
C14 50pf-1000V
C15 .0047μf 50V
C16 .0022μf 50V
C17 .01μf 16V
C18 100μf 10V
C19 .0022μf 50V
C20 .1μf 16V
C21 560pf 1KV
C23 4.7μf
C24 2.2μf
C25 .1μf
C26 .1μf
C28 .1μf
R1 4.7K
R2 22K
R3 22Ω
R4 6.8K
R5 1.8K
R6 340K
R7 100K
R8 56K
R11 150Ω
R12 7.5K
R13 100K
R14 4.7K
R15 39K
R16-2M
R17 330K
R18 1M
R19 2K
R20 680K
R21 750K
R22 4.7K
R23-1M
R24 2K
R25 680K
R26-1M
R27 270K
R28 120K
R29 150K
R30 150K
R31 270K
R32 120K
R35 1M
R36 2K
R37 1M
R38 1M
R39 100K
R40 470K
R41 100K
R44-2M

CAPACITIVE INTRUSION DETECTOR CIRCUITRY UTILIZING REFERENCE OSCILLATOR DRIFT

BACKGROUND OF THE INVENTION

This invention relates to electronic security apparatus for detecting intrusion by unauthorized personnel into close proximity with protected objects, such as file cabinets containing secret documents, safes containing valuable articles, etc. More particularly, this invention relates to electronic security apparatus for producing a field by exciting an antenna formed by connecting the protected objects together and for sensing a disturbance in the field due to an intrusion to activate an alarm.

The prior art discloses various electronic security apparatus with circuitry for exciting a protected-object antenna and for sensing a disturbance in the field due to an intrusion, as by sensing a shift in the frequency of an oscillator which excites the antenna due to a change in the capacitive reactance of the antenna when an intrusion occurs. One type of prior art circuitry which is highly sensitive to movement by an intruder is disclosed in Premack, U.S. Pat. No. 3,222,664.

The Premack patent discloses circuitry which includes two oscillators that are synchronized in frequency. The signal of one of the oscillators excites an antenna, such as formed by a perimeter fence. The signals of the two oscillators are fed to a phase detector which produces a phase-difference signal. An instantaneous change in the frequency of the oscillator signal that energizes the antenna, due to a change in the capacitive reactance of the antenna when an intrusion occurs, is reflected by a shift in phase between the two oscillator signals, so that the phase-difference signal produced by the phase detector changes to activate an alarm.

In order to synchronize the two oscillators, a switch is closed to provide a fixed coupling impedance between the two oscillators. Furthermore, AFC through feedback from the phase detector and a low pass filter to control the transconductance of the pentode in the oscillator which energizes the antenna can also be employed to extend the range over which the electronic security apparatus operates. Nevertheless, the fixed coupling impedance always interconnects the two oscillators even when AFC is employed.

Cowen, U.S. Pat. No. 2,907,017 refers generally to the problem of defeatability of electronic security apparatus by an intruder who determines the frequency of the signal which excites the antenna and connects a frequency generator operating at that frequency to the antenna. No specific reference is made to the type of circuit means disclosed in the Premack patent. Since the Premack patent discloses that the two oscillators are bidirectionally coupled by a fixed coupling impedance, however, the Premack electronic security apparatus is defeatable by connection of a frequency generator to the antenna.

SUMMARY OF THE INVENTION

Accordingly, one objective of this invention is to provide a highly sensitive electronic security apparatus having two oscillators, one of which excites an antenna, wherein the two oscillators are connected to a phase comparator which activates an alarm when an intrusion occurs. Another objective of this invention is to provide such an electronic security apparatus which is not defeatable by connection of a frequency generator to the antenna. A further objective of this invention is to provide such an electronic security apparatus which has high sensitivity but is not susceptible to false alarms and which is rapidly armed and rearmed without sacrifice of high sensitivity to different rates of movement by an intruder.

In accordance with a preferred embodiment of the electronic security apparatus of this invention, protected objects are connected together to form an antenna means. Preferably, the cabinet for the electronic security apparatus circuitry is also included in the antenna means.

The antenna means is excited by a voltage controlled oscillator (VCO). The capacitive reactance of the antenna means changes when an intrusion occurs so as to cause the frequency of the VCO signal to undergo an instantaneous change.

A phase comparator compares the phase of the VCO signal with the phase of a reference oscillator signal. An instantaneous change in the frequency of the VCO signal due to a change in the capacitive reactance of the antenna means is reflected by a shift in phase between the VCO signal and the reference oscillator signal. This causes the phase comparator signal to change.

The phase comparator signal is fed back to the VCO to synchronize the frequency of the VCO to the frequency of the reference oscillator so that no alarm is produced by slow changes in the capacitive reactance of the antenna means, such as due to variations in ambient conditions. The phase comparator signal is also fed to a deriving means, preferably including a dual differentiator circuit, which indicates relatively more rapid changes in the capacitive reactance of the antenna means due to an intrusion. The dual differentiator circuit derives the rate of the rate of change of the phase comparator signal and triggers a differential comparator included in the deriving means in the event of an intrusion. As a result, the differential comparator in turn activates a signaling circuit so as to produce an alarm.

Significantly, the antenna means is connected to the VCO, and there is no bidirectional coupling between the VCO and the reference oscillator. This renders the electronic security apparatus incapable of defeat by an intruder who determines the frequency of the signal which excites the antenna means and connects a frequency generator operating at that frequency to the antenna means, since inherent drift in the reference oscillator eventually produces an alarm.

Additionally, a means is provided which is operative in one mode for causing rapid stabilization of the dual differentiator circuit to arm or rearm the electronic security apparatus and which is operative in another mode for causing slow stabilization of the dual differentiator circuit, after the electronic security apparatus is once armed or rearmed. Consequently, an alarm is produced even if an intruder slowly approaches or withdraws from the antenna means.

A means is also provided for detecting that the antenna means has been severed or grounded, for example, during a period of time when the electronic security apparatus is not in use, such as during business hours. This renders the electronic security apparatus substantially tamperproof.

BRIEF DESCRIPTION OF THE DRAWING

This invention will be better understood and its concomitant advantages will be better appreciated by those of skill in the art after a consideration of the description which appears below in conjunction with the drawing. In the drawing.

DESCRIPTION

Figure 1:
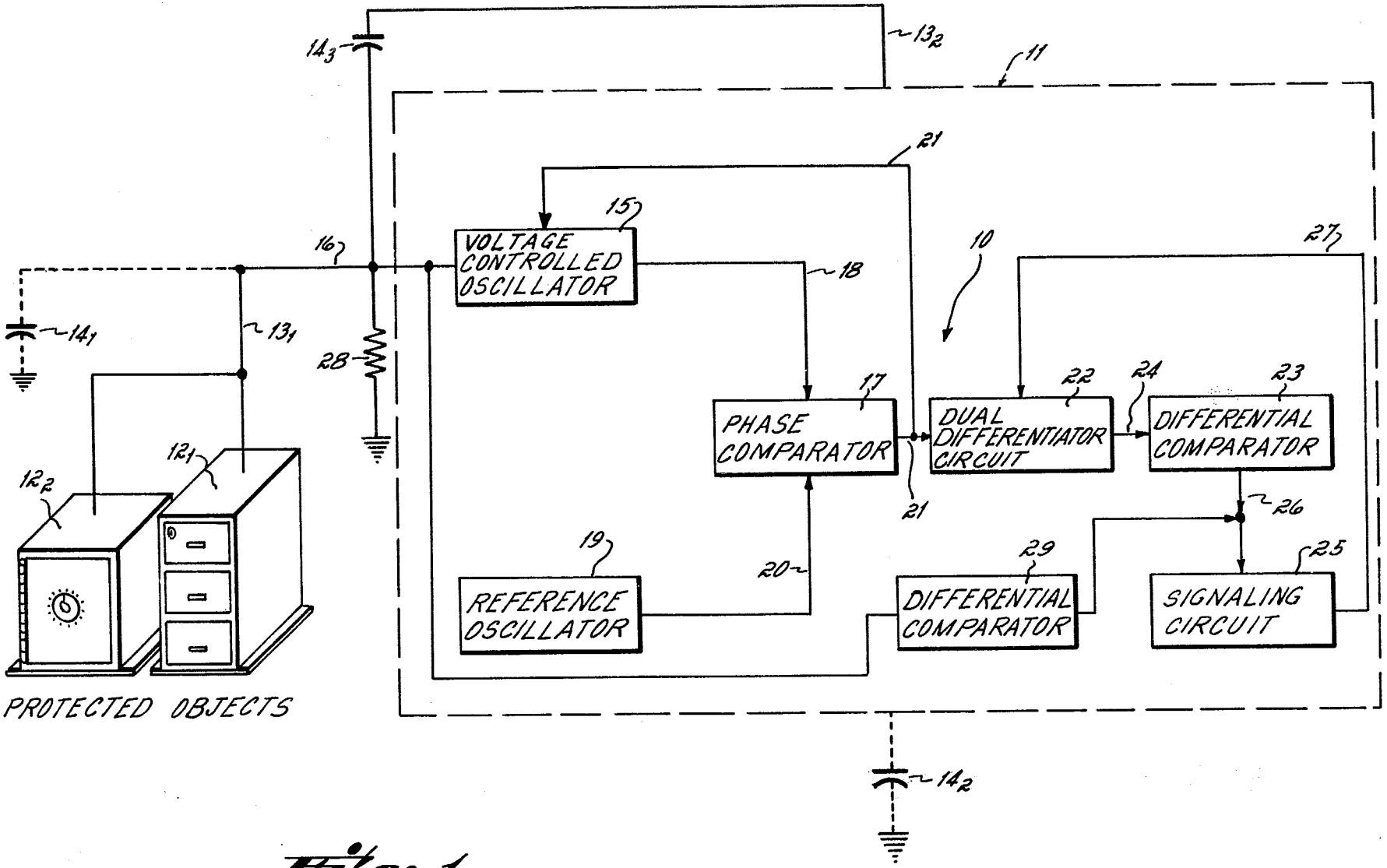
FIG. 1 is a block circuit diagram of a preferred embodiment for the electronic security apparatus of this invention and FIG. 2 is a schematic circuit diagram of the electronic security apparatus in FIG. 1.

A preferred embodiment for the electronic security apparatus of this invention, as indicated generally by the numeral 10 in FIG. 1, is mounted in a housing 11. One or more protected objects, such as a file cabinet $12_1$ and a safe $12_2$, and, preferably, the housing 11 are insulated from ground and connected together, as by the conductors $13_1$ and $13_2$, to form an antenna means.

The capacitive reactance of the antenna means is represented by the lumped capacitances $14_1$ and $14_2$. In order to adjust the sensitivity of the housing antenna with respect to the protected-object antenna, a capacitor $14_3$ is preferably included.

If an intrusion should occur in the vicinity of the protected objects or the housing, the capacitive reactance of the antenna means changes. Specifically, the capacitive reactance increases during ingress of an intruder and decreases during egress of an intruder.

The antenna means is excited by a VCO 15 via a conductor 16. When the capacitive reactance of the antenna means changes, such as when an intrusion occurs, the frequency of the VCO 15 changes instantaneously. During ingress of an intruder, the capacitive reactance increases which causes an instantaneous decrease in the frequency of the VCO signal. During egress of an intruder, the capacitive reactance decreases which causes an instantaneous increase in the frequency of the VCO signal.

The signal from the VCO 15 is fed to a phase comparator 17 via a conductor 18. A signal from a reference oscillator 19 is fed to the phase comparator 17 via a conductor 20. The phase comparator 17 compares the phase of the VCO signal with the phase of the reference oscillator signal.

The phase comparator signal is fed back to the VCO 15 via a conductor 21 to provide AFC for the VCO so that the VCO 15 and the reference oscillator 19 are synchronized in frequency, such as at a nominal frequency of 20 kHz. Slow changes in the capacitive reactance of the antenna means, such as due to variations in ambient conditions, as well as relatively more rapid changes in the capacitive reactance of the antenna means, such as due to movement by an intruder near the protected objects or the housing, cause instantaneous changes in the frequency of the VCO signal. An instantaneous change in the frequency of the VCO signal is reflected by a shift in phase between the VCO signal and the reference oscillator signal. Consequently, the phase comparator signal changes. Eventually, the phase comparator signal AFC synchronizes the VCO 15 with the reference oscillator 19.

The phase comparator signal, however, is fed via the conductor 21 to a means for deriving whether or not a change in the phase comparator signal is the result of an intrusion. Preferably, the deriving means includes a dual differentiator circuit 22, although a single differentiator circuit could be employed. The dual differentiator circuit 22 derives the rate of the rate of change of the phase comparator signal and triggers a first differential comparator 23 included in the deriving means via a conductor 24 in the event that the rate of the rate of change of the phase comparator signal indicates an intrusion. As a result, the differential comparator 23 in turn activates a signaling circuit 25 via a conductor 26 when an intrusion occurs.

Significantly, the antenna means is connected to the VCO 15. Furthermore, there is no bidirectional coupling between the VCO 15 and the reference oscillator 19. This renders the electronic security apparatus 10 incapable of defeat by an intruder who determines the frequency of the signal which excites the antenna means and connects a frequency generator operating at that frequency to the antenna means because inherent drift in the reference oscillator eventually produces an alarm. That is, if a frequency generator were connected to the antenna means to maintain the VCO signal at a constant frequency, the AFC feedback from the phase comparator 17 would be overridden such that there would be no compensation for relative drift between the VCO 15 and the reference oscillator 19. Consequently, as the reference oscillator drifts relative to the VCO as controlled by the frequency generator, the VCO and the reference oscillator loose synchronism and the phase comparator signal changes so as to produce an alarm.

A means included in the signaling circuit 25 is operative in one mode for controlling the dual differentiator circuit 22 via the conductor 27 to rapidly stabilize the dual differentiator circuit 22 to arm or rearm the electronic security apparatus. This means is also operative in another mode for controlling the dual differentiator circuit 22 via the conductor 27 to slowly stabilize the dual differentiator circuit after the electronic security apparatus is once armed or rearmed so that an alarm is produced even if an intruder slowly approaches or withdraws from the antenna means.

A means which includes a resistor 28 and a second differential comparator 29 for detecting that the antenna means has been severed or grounded is also connected to the signaling circuit 25 via the conductor 26. This means causes an alarm to be produced at the time that the electronic security apparatus is turned on if the antenna means has been tampered with during a period when the electronic security apparatus is not in use, such as during business hours.

Figure 2:
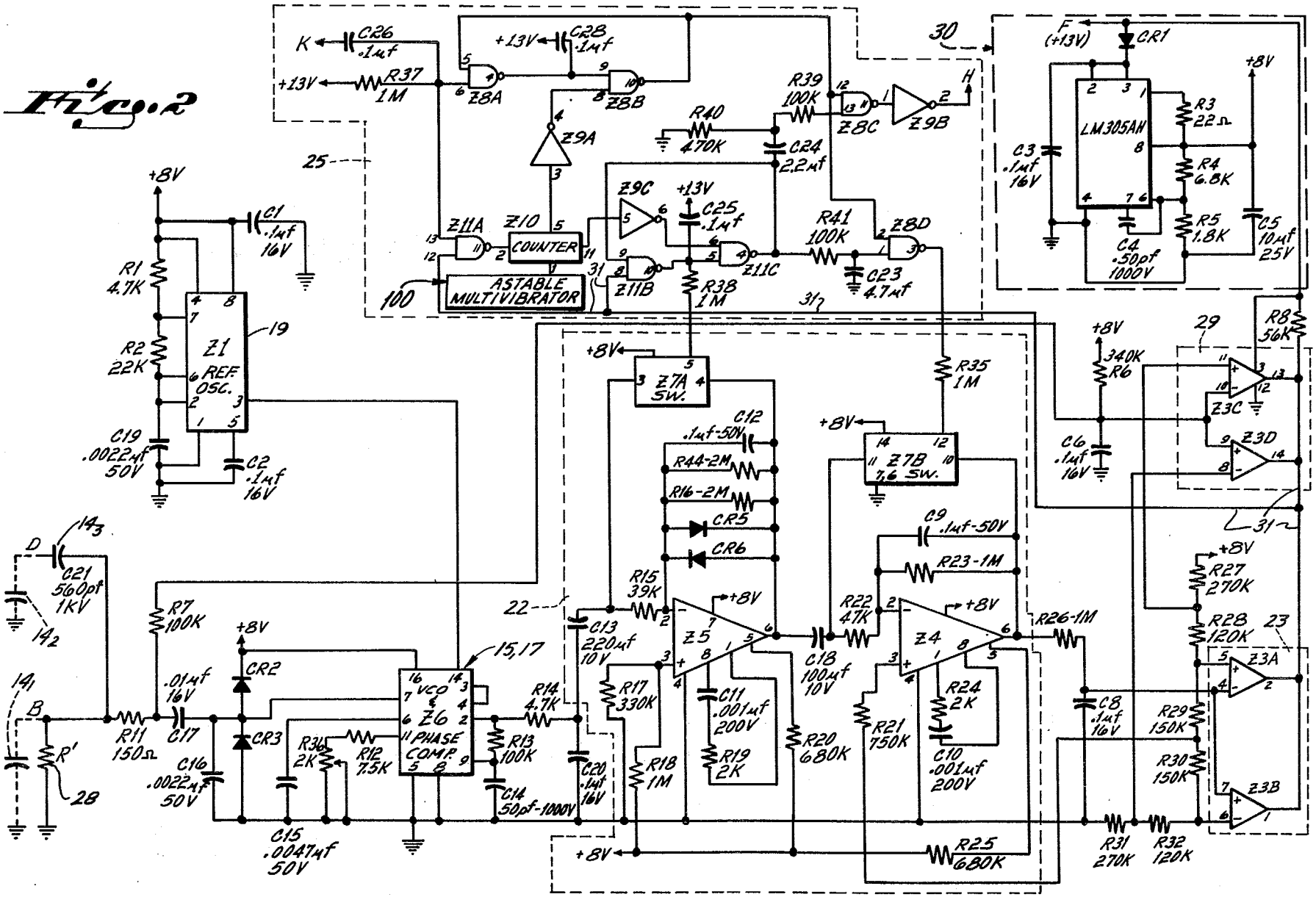

A schematic circuit diagram for the preferred embodiment of the electronic security apparatus of this invention is shown in FIG. 2. A power supply (not shown) which is preferably 13 volts d.c., is connected to a terminal F and the various other points labeled 13V in FIG. 2. A voltage regulator, which is designated by the numeral 30, is connected to the terminal F and provides a regulated 8 volts d.c. at the points labeled 8V in FIG. 2. The voltage regulator 30 forms no part of this invention and, consequently, will not be described further.

One or more protected objects which are insulated from ground are interconnected to form an antenna means which is connected to an input terminal B. The capacitive reactance of this antenna increases when an intruder approaches the protected objects and decreases when the intruder moves away from the protected objects. The housing for the circuitry which comprises the electronic security apparatus preferably is insulated from ground to form an antenna means which is connected to an input terminal D. The capacitive reactance of this antenna increases when an intruder intending to tamper with the circuitry approaches the housing and decreases when the intruder moves away from the housing. A capacitor C21, which adjusts the sensitivity of the antenna means formed by the housing, interconnects the input terminals B and D.

The antenna means is connected through a resistor R11 and a coupling capacitor C17 to pin 7 of a standard CD4046AE integrated circuit hereinafter referred to as Z6, which includes a voltage controlled oscillator (VCO). The frequency of oscillation of the VCO is determined by the capacitance of the antenna means and by capacitors C15 and C16 and by series-connected resistor R12 and potentiometer R36. The capacitor C15 is connected between pin 6 of Z6 and ground. The capacitor C16 is connected between pin 7 of Z6 and ground. The series-connected resistor R12 and potentiometer R36 are connected between pin 11 of Z6 and ground. The VCO output at pin 3 of Z6 is connected to a first input of a phase comparator at pin 4 of Z6.

Pin 14 of Z6 is a second input of the phase comparator. Pin 14 of Z6 is connected to pin 3 of a standard NE555V integrated circuit, hereinafter referred to as Z1. Pin 3 of Z1 is the output of a reference oscillator whose frequency of oscillation is established by a capacitor C19 and resistors R1 and R2. The capacitor C19 is connected between pin 2 of Z1 and ground. The resistor R1 is connected between pins 4 and 7 of Z1, and the resistor R2 is connected between pins 6 and 7 of Z1. Pin 2 of Z1 is directly connected to pin 6 of Z1. A bypass capacitor C1 is connected between pin 8 of Z1 and ground. Similarly, a bypass capacitor C2 is connected between pin 5 of Z1 and ground.

The phase comparator output at pin 2 of Z6 represents the phase difference between the VCO and reference oscillator outputs. The phase comparator output is fed back to the control input for the VCO at pin 9 of Z6 through a low pass filter which comprises a resistor R13 connected between pins 2 and 9 of Z6 and a capacitor C14 connected between pin 9 of Z6 and ground.

The phase comparator output is also connected through a low pass filter which comprises a resistor R14 and a capacitor C20 to the input of the first of two differentiators. Each differentiator has a structure similar to that disclosed in U.S. Pat. No. 2,901,609.

The first differentiator includes a series-connected differentiating capacitor C13 and a resistor R15 that connect the output of the low pass filter comprising the resistor R14 and the capacitor C20 to the inverting input at pin 2 of a standard CA3078S integrated circuit, hereinafter referred to as the first rate amplifier Z5. As a result, an input which represents the rate of change of phase difference between the VCO and reference oscillator outputs appears at the inverting input of the first rate amplifier Z5. Bias is applied to the noninverting input at pin 3 of the first rate amplifier Z5 by a divider circuit which comprises resistors R17 and R18. This biasing arrangement maintains a nominal value of two volts at the output at pin 6 of the first rate amplifier Z5. The first rate amplifier Z5 includes parallel-connected negative feedback resistors R16 and R44 which are connected in parallel with a bypass capacitor C12 between pins 2 and 6 of Z5.

The output of the first differentiator at pin 6 of the first rate amplifier Z5 is connected to the input of the second differentiator. The second differentiator includes a series-connected differentiating capacitor C18 and a resistor R22 that connect the output of the first differentiator to the inverting input at pin 2 of another standard CA3078S integrated circuit, hereinafter referred to as the second rate amplifier Z4. As a result, an input which represents the rate of the rate of change of phase difference between the VCO and the reference oscillator outputs appears at the inverting input of the second rate amplifier Z4. Bias is applied through a resistor R21 to the noninverting input at pin 3 of the second rate amplifier Z4 by a divider circuit which comprises resistors R27–R32. This biasing arrangement maintains a nominal value of four volts at the output of the second rate amplifier Z4. The second rate amplifier Z4 includes a negative feedback resistor R23 which is connected in parallel with a bypass capacitor C9 between pins 2 and 6 of Z4.

The output of the second differentiator at pin 6 of the second rate amplifier Z4 is connected through a low pass filter which comprises a resistor R26 and a capacitor C8 to the inverting input at pin 4 of one differential amplifier Z3A and also to the noninverting input at pin 7 of another differential amplifier Z3B. A divider circuit which comprises the resistors R27–R32 provides a nominal value of five volts reference at the noninverting input at pin 5 of the differential amplifier Z3A and a nominal value of three volts reference at the inverting input at pin 6 of the differential amplifier Z3B.

The output at pin 2 of the differential amplifier Z3A and the output at pin 1 of the differential amplifier Z3B are connected together. The differential amplifiers Z3A and Z3B are arranged as a first differential comparator. Since the output at pin 6 of the second rate amplifier Z4, which corresponds to the output of the second differentiator, is nominally four volts, the output of the first differential comparator is at a logic one state. However, when the input at pin 7 of the differential amplifier Z3B is less than the three volts reference at pin 6 or when the input at pin 4 of the differential amplifier Z3A is greater than the five volts reference at pin 5, the output of the first differential comparator transposes to a logic zero state. The output of the first differential comparator is connected to the input of a signaling circuit by a conductor 31.

The electronic security apparatus also preferably includes an antenna cable supervision circuit. The antenna cable supervision circuit includes a resistor R' which is connected in parallel with the protected object antenna. The resistor R' is connected in series with the resistor R11 and a resistor R7 to the inverting input at pin 10 of a differential amplifier Z3C and also to the noninverting input at pin 9 of a differential amplifier Z3D. The divider circuit which comprises the resistors R27–R32 provides a nominal value of six volts at the noninverting input at pin 11 of the differential amplifier Z3C and a nominal value of two volts at the inverting input at pin 8 of the differential amplifier Z3D.

The output at pin 13 of the differential amplifier Z3C and the output at pin 14 of the differential amplifier Z3D are connected together. The differential amplifiers Z3C and Z3D are, therefore, arranged as a second differential comparator.

A divider circuit which comprises the resistors R6, R7 and R11 as well as the resistor R' maintains a nominal value of four volts at the input of the second differential comparator. A bypass capacitor C6 is connected between the input of the second differential comparator and ground.

Since the input is nominally four volts, the output of the second differential comparator is at a logic one state. However, when the input at pin 9 of the differential amplifier Z3D is less than the two volts reference at pin 8 or when the input at pin 10 of the differential amplifier Z3C is greater than the six volts reference at pin 11, the output of the second differential comparator transposes to a logic zero state.

The differential amplifiers Z3A-D may comprise four differential amplifiers of a standard LM3302N integrated circuit. Also, the outputs of the first and second differential comparators are shown joined together and connected by R8 to 13V. This provides proper signal level at the common output of the first and second differential comparators for input to the signaling circuit. The output of the second comparator is connected in parallel with the output of the first comparator to the input of the signaling circuit by the conductor 31.

In operation, the common output of the first and second differential comparators is normally at a logic one state. If an intruder approaches the protected-object antenna or the housing antenna, the capacitive reactance of the antenna increases so that the frequency of the VCO tends to instantaneously decrease. This is reflected in a rapid change in the phase relationship between the VCO and reference oscillator outputs. Consequently, the phase comparator produces a positive-going output. The phase comparator output is differentiated by the first differentiator and then differentiated again by the second differentiator. A positive-going output appears at the output of the second differentiator which triggers the first differential comparator to a logic zero state. This in turn causes the signaling circuit to produce a one-second pulse at terminal H to activate an alarm as will be described in more detail later.

If the intruder moves away, the capacitive reactance decreases so that the frequency of the VCO tends to instantaneously increase. This results in a negative-going phase comparator output. Consequently, a negative-going output appears at the output of the second differentiator which triggers the first differential comparator to a logic zero state. This in turn produces a one-second pulse at terminal H to activate an alarm.

If the protected-object antenna is severed, which means that the resistor R′ is disconnected, a positive-going input triggers the second differential comparator to a logic zero state. If the protected-object antenna is grounded, which means that the resistor R′ is short-circuited, a negative-going input triggers the second differential comparator to a logic zero state. If the protected-object antenna is severed or grounded during the time that the electronic security apparatus is not in operation, such as during daytime business hours, nevertheless, after activation of the electronic security apparatus, the input to the second differential comparator will be outside the reference range of two to six volts, and the second differential comparator output will be at a logic zero state. In any case, if the protected-object antenna is severed or grounded, the signaling circuit produces an output at terminal H to activate an alarm as will be described in more detail later.

The activation of an alarm due to either an intrusion or an attempt to defeat the electronic security apparatus by severing or grounding the protected object antenna as well as the dual time constant stabilization of the two rate amplifiers during arm and rearm of the electronic security apparatus is interrelated with the operation of the signaling circuit. When the electronic security apparatus is turned on, a logic zero state appears at an input terminal K. Consequently, a negative-going pulse appears at pin 6 of a NAND gate Z8A. As a result, the output at pin 4 of the NAND gate Z8A transposes to a logic one state. This produces a logic one state at pin 9 of a NAND gate Z8B whose other input at pin 8 also has a logic one state applied thereto.

Specifically, when power is turned on, a negative-going pulse appears at pin 13 of a NAND gate Z11A. As a result, the output at pin 11 of the NAND gate Z11A transposes to a logic one state. This produces a logic one state at the reset pin 2 of a counter Z10, which comprises a standard CD4024AE integrated circuit.

The counter Z10 is reset and begins to accumulate pulses input to the clock input at pin 1 by an astable multivibrator 100. Immediately after reset, however, the output at pin 5 of the counter Z10 is at a logic zero state which appears at the input at pin 3 of an inverter Z9A. Consequently, the output at pin 4 of the inverter Z9A transposes to a logic one state so that a logic one state appears at pin 8 of the NAND gate Z8B.

Due to the presence of a logic one state at pins 8 and 9 of the NAND gate Z8B, the output at pin 10 of the NAND gate Z8B transposes to a logic zero state. This places pin 12 of a NAND gate Z8C at a logic zero state so that the output at pin 11 of the NAND gate Z8C transposes to a logic one state. Consequently, a logic one state appears at the input at pin 1 of an inverter Z9B. As a result, the output at pin 2 of the inverter Z9B remains at a logic zero state so that no alarm pulse appears at the terminal H.

When power is turned on, a rapid stabilization occurs so as to arm the electronic security apparatus for detecting an intrusion. A positive-going pulse is input through a capacitor C25 to set a latch formed by a NAND gate Z11B and a NAND gate Z11C so that the output at pin 10 of the NAND gate Z11B is at a logic one state. Consequently, a positive-going pulse is input through a resistor R38 to pin 5 of an electronic switch Z7A closing an internal circuit between pins 3 and 4 of the electronic switch Z7A to cause rapid stabilization of the first rate amplifier Z5 by short-circuiting the resistor R15 and the feedback resistors R16 and R44. Furthermore, the output at pin 10 of the NAND gate Z8B is connected to pin 2 of a NAND gate Z8D. When the output at pin 10 of the NAND gate Z8B transposes to a logic zero state as described above, the output at pin 3 of the NAND gate Z8D transposes to a logic one state. Consequently, a positive-going pulse is input through a resistor R35 to pin 12 of an electronic switch Z7B closing an internal circuit between pins 10 and 11 of the electronic switch Z7B to cause rapid stabilization of the second rate amplifier Z4 by short-circuiting the resistor R22 and the feedback resistor R23.

Approximately seven seconds after the counter Z10 is reset, pin 11 of the counter Z10 transposes to a logic one state. This logic one state appears at the input at pin 5 of an inverter Z9C which causes the output at pin 6 of the inverter Z9C to transpose to a logic zero state which appears at the input at pin 6 of the NAND gate Z11C. Consequently, the output at pin 4 of the NAND gate Z11C transposes to a logic one state to reset the latch formed by the NAND gates Z11B and Z11C. As a result, the electronic switches Z7A and Z7B open so as to ready the electronic security apparatus for detecting an intrusion.

Approximately one minute after the electronic security apparatus is turned on, pin 5 of the counter Z10 transposes to a logic one state. The one-minute time interval provides a period during which the first and second rate amplifiers Z5 and Z4, as well as the other elements of the electronic security apparatus, assume a stable armed condition ready to detect approach of an intruder or severance or gounding of the antenna means. When pin 5 of the counter Z10 transposes to a logic one state, this logic one state appears at the input at pin 3 of the inverter Z9A. Consequently, the output at pin 4 of the inverter Z9A transposes to a logic zero state. Since the output of the inverter Z9A is connected to the input at pin 8 of the NAND gate Z8B, the output at pin 10 of the NAND gate Z8B transposes to a logic one state.

The logic one state at the output of the NAND gate Z8B is fed back to the input at pin 5 of the NAND gate Z8A whose output at pin 4 therefore transposes to a logic zero state. This places the input at pin 9 of the NAND gate Z8B at a logic zero state and, consequently, latches the output at pin 10 of the NAND gate Z8B at a logic one state which appears at the input at pin 12 of the NAND gate Z8C.

When one of the first and second comparators is triggered due to an alarm condition, such as an intruder or severed or grounded antenna means, pin 12 of the NAND gate Z11A and pin 8 of the NAND gate Z11B are placed at a logic zero state. Consequently, the outputs at pins 11 and 10 of the respective NAND gates Z11A and Z11B transpose to a logic one state to reset the counter Z10 and place a logic one state at the input at pin 5 of the NAND gate Z11C, respectively.

When the counter Z10 is reset, pin 11 of the counter Z10 transposes to a logic zero state which appears at the input at pin 5 of the inverter Z9C. Consequently, the output at pin 6 of the inverter Z9C transposes to a logic one state which appears at the input at pin 6 of the NAND gate Z11C. As a result, a logic one state appears at each input of the NAND gate Z11C, and the latch formed by the NAND gates Z11B and Z11C is set so that the output at pin 4 of the NAND gate Z11C transposes to a logic zero state.

The logic zero state at the output of the NAND gate Z11C is fed back to the input at pin 9 of the NAND gate Z11B whose output at pin 10 therefore is held at a logic one state which appears at the input at pin 5 of the NAND gate Z11C. Consequently, the input at pin 5 of the NAND gate Z11C is held at a logic one state even if the alarm condition lasts only a short time.

Approximately seven seconds after the counter Z10 is reset, pin 11 of the counter Z10 transposes to a logic one state. This logic one state appears at the input at pin 5 of the inverter Z9C which causes the output at pin 6 of the inverter Z9C to return to a logic zero state which appears at the input at pin 6 of the NAND gate Z11C. Consequently, the output at pin 4 of the NAND gate Z11C transposes to a logic one state, and the latch formed by the NAND gates Z11B and Z11C is reset. As a result, a positive-going pulse passes through the differentiating capacitor C24 and the input resistor R39 to the input at pin 13 of the NAND gate Z8C. This causes the output at pin 11 of the NAND gate Z8C to transpose to a logic zero state.

The logic zero state at the output of the NAND gate Z8C appears at the input at pin 1 of the inverter Z9B. Consequently, the output at pin 2 of the inverter Z9B transposes to a logic one state which appears at the terminal H to activate an alarm.

The seven-second time interval provides a period during which the first and second rate amplifiers Z5 and Z4 are restabilized under an alarm condition so that an additional intruder is detected or departure of the first intruder or tampering with the electronic security apparatus produces another alarm. In order to regeneratively rearm the electronic security apparatus, the logic one state at the output at pin 10 of the NAND gate Z11B is input to the electronic switch Z7A so that the resistors R15, R16 and R44 are short-circuited to rapidly stabilize the first rate amplifier Z5. Also, the output at pin 4 of the NAND gate Z11C is connected by a time delay circuit which comprises a capacitor C23 and a resistor R41 to the input at pin 1 of the NAND gate Z8D. Consequently, when the output at pin 4 of the NAND gate Z11C transposes to a logic zero state, the output at pin 3 of the NAND gate Z8D transposes to a logic one state. The logic one state at the output at pin 3 of the NAND gate Z8D is input to the electronic switch Z7B so that the resistors R22 and R23 are short-circuited to rapidly stabilize the second rate amplifier Z4.

The NAND gates preferably comprise two standard CD4011AE integrated circuits, and the inverters preferably comprise a standard CD4069BE integrated circuit. Furthermore, the electronic switches preferably comprise a standard CD4016AE integrated circuit. The parametric values for the resistors and capacitors preferably are as listed in FIG. 2. The schematic circuit in FIG. 2, however, can be modified such that a negative polarity voltage is used and different connections and logic elements are employed to construct an equivalent circuit. Other modifications may also occur to those of skill in the art without departure from the scope of this invention.

Accordingly, this invention provides a highly sensitive electronic security apparatus for detecting intrusion wherein the apparatus cannot be defeated by an intruder who determines the frequency at which the antenna is excited and connects a frequency generator operating at that frequency to the antenna, because drift in the reference oscillator eventually produces an alarm. Furthermore, the apparatus is armed rapidly when the power is turned on and rearmed rapidly when the intrusion near the protected objects or the housing for the circuitry occurs so as to ready the apparatus to immediately detect a change in the alarm condition, such as an intruder drawing closer or moving away from a protected object. Also, an alarm is produced if the apparatus is tampered with as by severing or grounding the antenna means.

Having described my invention, I claim:

1. An electronic security apparatus for detecting intrusion near protected objects connected together to form an antenna means, said apparatus comprising:

a voltage controlled oscillator means connected to said antenna means for producing a signal to excite said antenna means, said voltage controlled oscillator signal having a frequency which changes instantaneously when the capacitive reactance of said antenna means changes due to an intrusion;

a reference oscillator means having inherent drift for producing a reference oscillator signal;

a phase comparator means connected to said voltage controlled oscillator means and to said reference oscillator means for producing a phase comparator signal representative of the phase difference between said voltage controlled oscillator signal and said reference oscillator signal;

means to feed back said phase comparator signal to said voltage controlled oscillator means to synchronize said voltage controlled oscillator signal to said reference oscillator signal, said voltage controlled oscillator means and said reference oscillator means having no bidirectional coupling therebetween; and deriving means connected to said phase comparator means for activating a signaling circuit means to produce an alarm when a change in said phase comparator signal due to an instantaneous change in said voltage controlled oscillator signal frequency indicates an intrusion;

whereby, if a frequency generator is connected to said antenna means in an attempt to defeat said apparatus, drift in said reference oscillator signal frequency also causes said phase comparator signal to change so that said deriving means activates said signaling circuit means to produce an alarm.

2. The electronic security apparatus of claim 1 wherein said deriving means comprises a dual differentiator circuit for deriving the rate of the rate of change of said phase comparator signal and a differential comparator connected to said dual differentiator circuit for activating said signaling circuit means when the rate of the rate of change of said phase comparator signal due to an instantaneous change in said voltage controlled oscillator signal frequency indicates an intrusion or when the rate of the rate of change of said phase comparator signal due to drift of said reference oscillator signal frequency with respect to a frequency generator signal frequency indicates an attempt to defeat said apparatus.

3. The electronic security apparatus of claim 2 wherein said signaling circuit means includes a means which is operative in one mode for causing rapid stabilization of said dual differentiator circuit to arm said apparatus and which is operative in another mode for causing slow stabilization of said dual differentiator circuit, whereby said apparatus is quickly armed when turned on but once armed is effective to produce an alarm even if an intruder slowly approaches or withdraws from said antenna means.

4. The electronic security apparatus of claim 1 further including means connected to said antenna means for activating said signaling circuit means when said antenna means is severed or when said antenna means is grounded.

5. The electronic security apparatus of claim 1, 2, 3 or 4 wherein said apparatus is mounted in a housing and said housing is included in said antenna means.

6. An electronic security apparatus for detecting intrusion near protected objects connected together to form an antenna means, said apparatus comprising:

a voltage controlled oscillator connected to said antenna means for producing a signal to excite said antenna means, said voltage controlled oscillator signal having a frequency which changes instantaneously when the capacitive reactance of said antenna means changes due to an intrusion;

a reference oscillator having inherent drift for producing a reference oscillator signal;

said voltage controlled oscillator and said reference oscillator having no bidirectional coupling therebetween;

a phase comparator connected to said voltage controlled oscillator and to said reference oscillator for producing a phase comparator signal representative of the phase difference between said voltage controlled oscillator signal and said reference oscillator signal;

said phase comparator signal being fed back to said voltage controlled oscillator to provide automatic frequency control for synchronizing said voltage controlled oscillator and said reference oscillator;

a dual differentiator circuit connected to said phase comparator for deriving the rate of the rate of change of said phase comparator signal; and a differential comparator connected to said dual differentiator circuit for activating a signaling circuit when the rate of the rate of change in said phase comparator signal due to an instantaneous change in said voltage controlled oscillator signal frequency indicates an intrusion or when the rate of the rate of change in said phase comparator signal due to drift of said reference oscillator signal frequency with respect to a frequency generator signal frequency connected to said antenna means indicates an attempt to defeat said apparatus.

7. The electronic security apparatus of claim 6 wherein said dual differentiator circuit includes a first differentiator having a differentiating capacitor, a resistor and a first rate amplifier connected in series and a first switch connected across said resistor and first rate amplifier and a second differentiator having a differentiating capacitor, a resistor and a second rate amplifier connected in series and a second switch connected across said resistor and second rate amplifier and wherein said signaling circuit is connected to said first and second switches and is operative in one mode for closing said switches to rapidly stabilize said dual differentiator circuit so as to arm said apparatus and is operative in another mode for opening said switches to slowly stabilize said dual differentiator circuit, whereby said apparatus is quickly armed when turned on but once armed is effective to produce an alarm even if an intruder slowly approaches or withdraws from said antenna means.

8. The electronic security apparatus of claim 6 further including:

a divider circuit including a resistor connected between said antenna means and ground; and a second differential comparator connected to said divider circuit for activating said signaling circuit when said resistor is short-circuited to indicate a grounded antenna means or when said resistor is open-circuited to indicate a severed antenna means.

9. The electronic security apparatus of claim 6, 7 or 8 wherein said apparatus is mounted in a housing and said housing is included in said antenna means.

* * * * *